US007509895B2

(12) United States Patent
Engvall et al.

(10) Patent No.: US 7,509,895 B2
(45) Date of Patent: Mar. 31, 2009

(54) SELF-ADJUSTING LOCKING PLIERS

(75) Inventors: David P. Engvall, Stanley, NC (US); Thomas M. Chervenak, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/552,553

(22) Filed: Oct. 25, 2006

(65) Prior Publication Data

US 2008/0098861 A1 May 1, 2008

(51) Int. Cl.
*B25B 7/12* (2006.01)
*B25B 7/04* (2006.01)

(52) U.S. Cl. ..... 81/368; 81/405; 81/374; 81/355

(58) Field of Classification Search ..... 81/367–385, 81/343, 344, 405, 355
See application file for complete search history.

(56) References Cited

U.S. PATENT DOCUMENTS

| | | | | | |
|---|---|---|---|---|---|
| 2,420,020 | A | * | 5/1947 | Snell | 81/377 |
| 2,464,472 | A | | 3/1949 | Ward et al. | |
| 2,496,309 | A | * | 2/1950 | Pugh | 81/380 |
| 2,525,630 | A | | 10/1950 | Albrecht | |
| 2,777,347 | A | * | 1/1957 | Sendoykas | 81/379 |
| 2,988,941 | A | * | 6/1961 | Ortman | 81/344 |
| 3,208,319 | A | | 9/1965 | Westby et al. | |
| 3,252,360 | A | | 5/1966 | Ortman | |
| 3,600,986 | A | * | 8/1971 | Baldwin | 81/370 |
| 4,662,252 | A | * | 5/1987 | Warheit | 81/341 |
| 5,385,072 | A | * | 1/1995 | Neff | 81/405 |
| 6,065,376 | A | * | 5/2000 | Khachatoorian | 81/355 |
| 6,212,978 | B1 | | 4/2001 | Seber et al. | |
| 6,227,081 | B1 | * | 5/2001 | Bally et al. | 81/389 |
| 6,279,431 | B1 | * | 8/2001 | Seber et al. | 81/357 |
| 6,591,719 | B1 | * | 7/2003 | Poole et al. | 81/370 |
| 6,862,962 | B1 | * | 3/2005 | Delbrugge et al. | 81/405 |
| 7,134,365 | B2 | | 11/2006 | Hile | |
| 2004/0255729 | A1 | | 12/2004 | Poole et al. | |
| 2007/0283791 | A1 | | 12/2007 | Engvall et al. | |

FOREIGN PATENT DOCUMENTS

| | | |
|---|---|---|
| WO | 03008152 | 1/2003 |

OTHER PUBLICATIONS

UK Search Report under Section 17(5) dated Oct. 1, 2007.
Irwin Industrial Tools, International Patent Application No. PCT/US07/82512—International Search Report and Written Opinion, dated Apr. 11, 2008.

* cited by examiner

*Primary Examiner*—Hadi Shakeri
(74) *Attorney, Agent, or Firm*—Dennis J. Williamson; Matthew W. Witsil; Moore & Van Allen PLLC

(57) ABSTRACT

The self-adjusting locking pliers include a body having a fixed jaw supported at one end. A moveable jaw is pivotably supported on the body at a slidable pivot connection. A linkage transmits a force applied to the handles of the pliers to the jaws and locks the jaws in the clamping position. The linkage allows the angle between the links to be preset to thereby control the clamping force applied to the work piece. The movable jaw is selectively attached to the linkage in one of two positions such that the jaw span may be adjusted without affecting the geometry of the linkage.

19 Claims, 7 Drawing Sheets

SELF-ADJUSTING LOCKING PLIERS

This invention relates to pliers, and more particularly, to self-adjusting locking pliers that enable the clamping force generated by the device to be pre-set.

BACKGROUND OF THE INVENTION

Self-adjusting or auto-adjusting pliers are known. Such pliers have jaws which are self-adjusting accordingly to the size of the work piece to be grasped between the jaws. Examples of such self-adjusting pliers are disclosed in U.S. Pat. No. 6,065,376 and U.S. Pat. No. 6,279,431.

Also known are locking pliers which incorporate an over-center compound toggle locking mechanism or linkage whereby when the moveable jaw of the pliers is adjusted to seize a work piece firmly between the moveable and the fixed jaw and the handles are tightly compressed, the toggle mechanism locks the hand tool onto the work piece. Examples of this type of pliers are disclosed in U.S. Pat. No. 5,056,385 and U.S. Pat. No. 6,626,070 (locking pliers sold under the trademark VISE-GRIP).

Self-adjusting locking pliers are also known. Such pliers include jaws that are self-adjusting according to the size of the work piece to be clamped between the jaws and that use an over-center compound toggle locking mechanism to firmly clamp the work piece. One example of such a pliers is disclosed in U.S. Pat. No. 6,941,844. Another example of such a pliers is disclosed in U.S. Pat. No. 6,591,719. Self-adjusting locking pliers are not all capable of generating the high clamping forces that are expected of locking pliers and some designs are susceptible to back drive forces that can inadvertently force open the pliers under high loads. Thus, an improved self-adjusting locking pliers is desired.

SUMMARY OF THE INVENTION

In one embodiment the self-adjusting locking pliers of the present invention include a fixed assembly having a body that forms a fixed handle and a plate or fixed jaw supported at one end thereof. A lever or movable handle is pivotably connected to a moveable jaw. The moveable jaw is pivotably supported on the body at a locking slidable pivot connection whereby the moveable jaw is permitted to close down on a work piece disposed between the jaws for providing self-adjustment of the jaws for different sized work pieces.

The locking slidable pivot connection includes a pawl secured to the moveable jaw by a first pivot where the pivot and pawl are moveable within a slot formed in the body. The pawl may be provided with forwardly facing teeth for engaging a rack of teeth on a front edge of the slot for providing selective engagement therebetween. The pawl is normally disengaged from the rack and engages the rack when the jaws contact a work piece. The rack of teeth may include a first set of teeth and a second set of teeth extending parallel to one another along the front edge of the slot. The first set of teeth and the second set of teeth may each be engaged by the pawl teeth. The teeth of the first set of teeth may be offset from the teeth of the second set of teeth by up to ½ of the pitch. As a result, the pitch of the rack of teeth is effectively reduced by one-half without making the teeth smaller or reducing the actual pitch of the teeth. One pawl may engage the first set of teeth a tooth higher or lower than the other pawl engages the second set of teeth such that the effective pitch is one-half the actual tooth pitch.

A linkage is provided that connects the movable jaw, operating lever and body so as to transmit a force applied to the handles of the pliers to the jaws and to lock the jaws in the clamping position on the work piece. The linkage allows the angle between the links to be preset to thereby control the clamping force applied to the work piece. The linkage also allows the preset clamping force to be maintained on different work pieces through repeated clamping and unclamping operations of the pliers.

The movable jaw is selectively attached to the lever in one of two positions such that the jaw span may be adjusted to accommodate relatively larger or smaller work pieces. The jaw span is adjusted in a manner such that the operation of the linkage is not affected by the position of the movable jaw.

DETAILED DESCRIPTION OF EMBODIMENTS OF THE INVENTION

Figure 6:
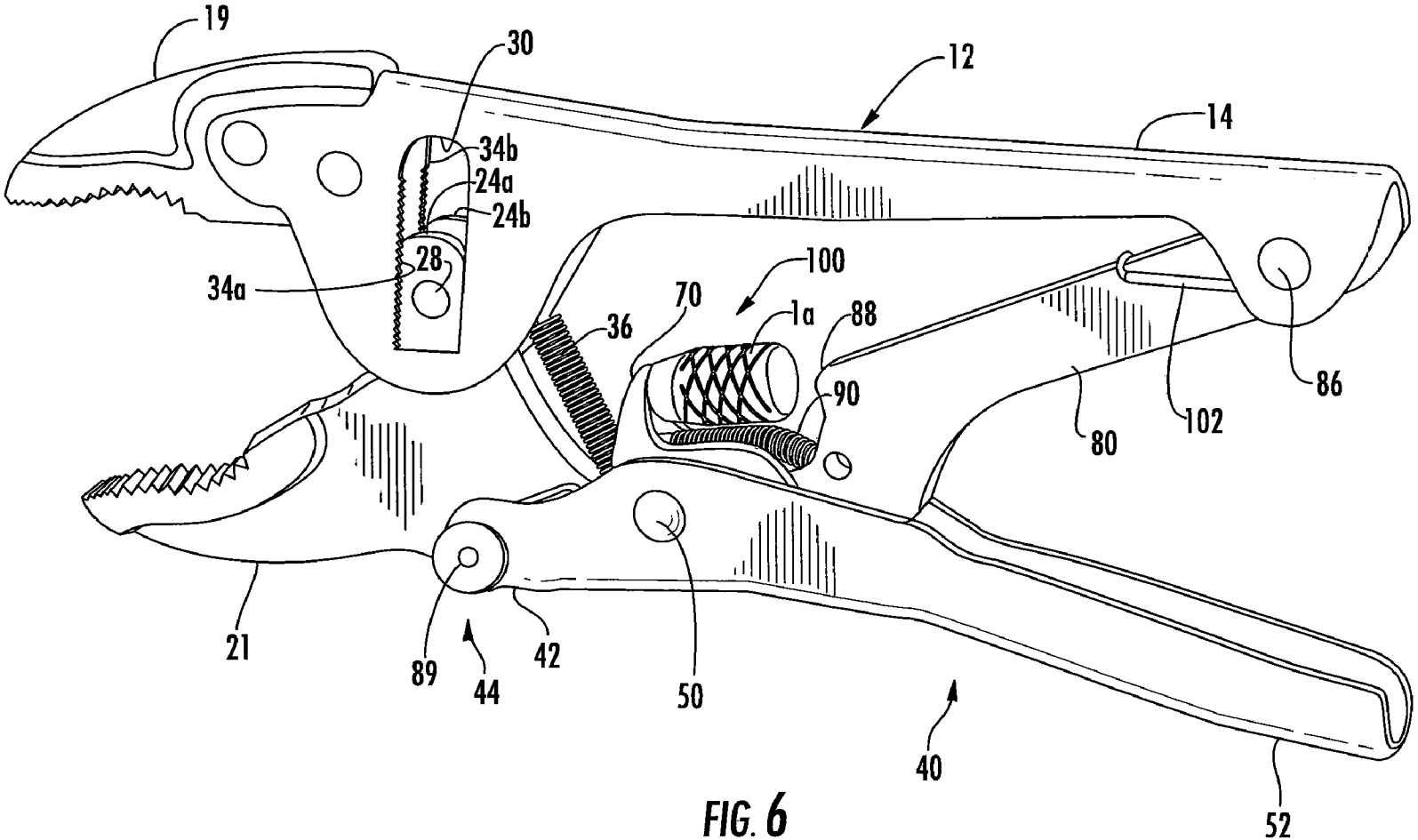
FIG. 6 is a perspective view of an alternate embodiment of the self-adjusting locking pliers of the present invention with the jaws shown between the fully open and fully closed positions.

Referring to the Figures, an embodiment of the self-adjusting locking pliers 10 of the invention is shown comprising a fixed assembly including a body 12 having a fixed handle 14 at one end thereof. The other end 16 supports a fixed plate or jaw 18. The fixed jaw 18 may be made integrally with the body 12 or may be a separate member rigidly connected with the body. In the illustrated embodiment the body 12 is shown as a separately identifiable element from fixed jaw 18. Where the body 12 and fixed jaw 18 are formed integrally with one another, a clear line of demarcation may not be visible between these elements such that elements disclosed herein as being arranged on the body may in some embodiments be arranged on a portion of the jaw structure or on a transition area between the jaw and body. The jaws 18 and 20 shown in the embodiments of FIGS. 1 through 5 are large jaws suitable for use as a clamp while the jaws 19 and 21 shown in the embodiment of FIG. 6 are jaws suitable for use as a pliers. Other jaw structures may also be used. The device shown in FIGS. 1 through 5 and the device shown in FIG. 6 are identical other than the configuration of the jaws. The mechanism described herein with reference to the Figures can be applied to tools such as clamps, pliers, long-nose pliers, specialty pliers or other clamping/torque producing devices.

A moveable jaw 20 is pivotably supported on body 12 via pivot 22 which is comprised of a locking slidable pivot connection. An operating lever 40 is connected to the moveable jaw 20 at a pivot 44. A linkage or toggle mechanism comprising a middle link 70 and a rear link 80 converts the movement of lever 40 into the opening and closing motion of jaw 20 and locks the jaw 20 in the clamping position relative to fixed jaw 18 as will hereinafter be described.

Figure 1:
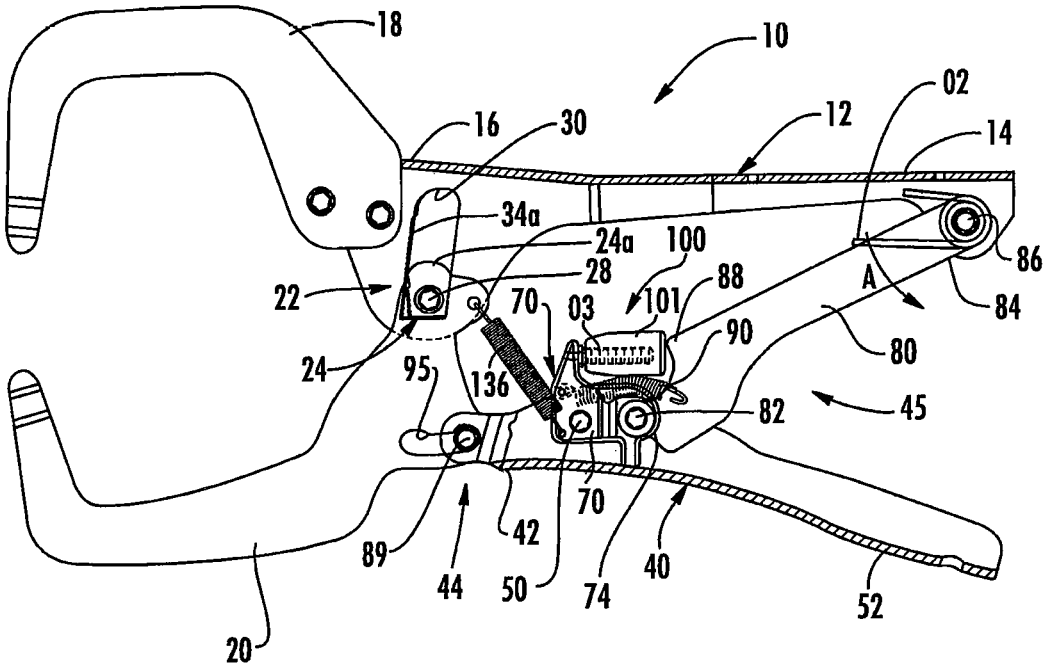
FIG. 1 is a partial section, side elevation view of the self-adjusting locking pliers of the present invention with the jaws shown in the fully open position set for smaller size work pieces.
Figure 2:
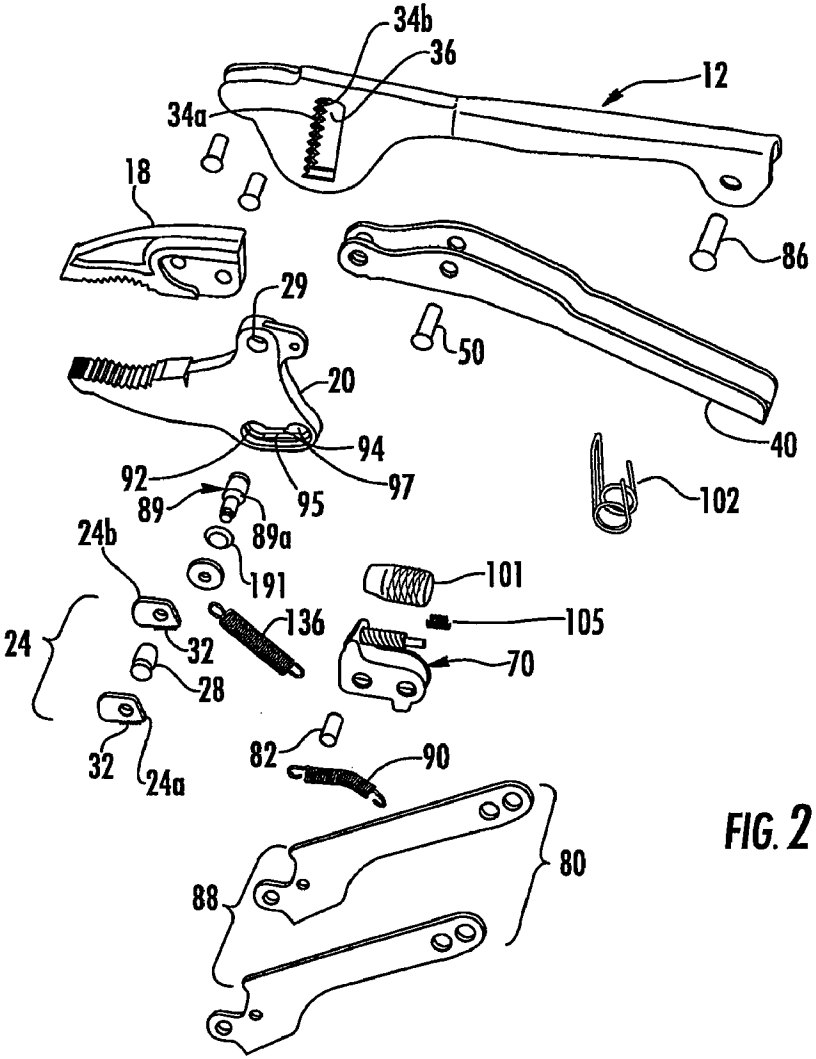
FIG. 2 is an exploded view of the jaws of FIG. 1.

Referring to FIGS. 1 and 2, the locking slidable pivot connection 22 comprises a pawl structure 24 that comprises a first pawl 24*a* that is located to one side of moveable jaw 20 and a second pawl 24*b* located on the opposite side of moveable jaw 20 mounted on pivot pin 28. Pin 28 is located in hole 29 formed in movable jaw 20. The pawl structure 24 is moveable within slot 30 that extends in body 12 generally transversely to the body 12 such that the pawl structure 24 can reciprocate in slot 30. Pawls 24*a* and 24*b* are provided with forwardly facing teeth 32 for engaging racks of teeth 34*a* and 34*b* formed on the front edge of slot 130.

Tension spring 36 is connected between movable jaw 20 and pivot pin 50 for biasing the movable jaw carrying pawl structure 24 away from racks 34*a* and 34*b* such that pawl teeth 32 are normally disengaged from racks of teeth 34*a* and 34*b*. As lever 40 is moved towards body 12, pawl structure 24 moves in the slot 30 to automatically space the movable jaw 20 the proper distance from fixed jaw 18 based on the size of the work piece. Pawl structure 24 moves in slot 30 until moveable jaw 20 contacts the work piece. When movable jaw 20 contacts the work piece, continued movement of lever 40 moves movable jaw 20 to the left as viewed in FIG. 1 such that the pawl teeth 32 on pawls 24*a* and 24*b* are forced into engagement with the racks of teeth 34*a* and 34*b* to "lock" the pawl 24 into position thereby fixing the location of pivot 28. Once the pawls 24*a* and 24*b* engage the racks of teeth 34*a* and 34*b*, pawl structure 24 cannot move in slot 30 such that further movement of operating lever 14 results in the rotation of movable jaw 20 about pivot pin 28 (clockwise as viewed in FIG. 1). As greater force is applied to lever 40, a larger clamping force is applied to the work piece by jaws 18 and 20.

The size and pitch of the teeth determines the incremental distance between adjacent positions of the pawl structure 24 in slot 30—the larger the pitch the greater the distance between adjacent pawl positions. Pitch being defined as the distance between adjacent teeth. Over the same distance, large teeth having a large pitch provide fewer, more widely spaced incremental positions than smaller teeth having a smaller pitch. The greater the distance between the incremental positions, the less precise the size adjustment of the jaws. For work pieces of the same size, when the pawl teeth 32 engage the racks of teeth 34*a* and 34*b*, the pawl teeth may "catch" and seat in any one of two or three adjacent teeth on the rack. If the tooth pitch is large, the difference in the force applied by the jaws to a work piece due to the engagement of the pawl with one rack tooth versus an adjacent rack tooth is great.

One way to solve this problem is to use teeth that are relatively small where the tooth pitch is also relatively small. In such an arrangement the difference in jaw spacing due to the engagement of the pawl with one rack tooth versus an adjacent rack tooth is minimized. One problem with such an approach is that small teeth can be relatively difficult to manufacture. Another problem is that smaller teeth are relatively weaker than larger teeth and are more likely to fail under a load. Another problem with small teeth is that the teeth are more easily fouled with dirt and debris such that engagement of the teeth may become unreliable.

To avoid these problems, yet provide a small incremental distance between adjacent positions of the pawl on the rack, two racks of teeth 34*a* and 34*b* are used. Rack of teeth 34*a* rack of teeth 34*b* extend parallel to one another along the front edge of slot 30. The set of teeth of rack 34*a* and the set of teeth of rack 34*b* may comprise relatively large teeth where and the teeth of each rack may be the same size and shape and have the same pitch. The teeth of the first rack 34*a* may be offset from the teeth of the second rack 34*b* by up to ½ of the pitch. Thus, in the illustrated embodiment the peaks of the teeth of rack 34*a* align with the valleys of the teeth of rack 34*b*. The teeth of pawl 24*a* engage the teeth of rack 34*a* and the teeth of the other pawl engage the teeth of rack 34*b*. Because the teeth of racks 34*a* and 34*b* are offset, the distance between adjacent positions of the pawl 24 is reduced by one half. As a result, the pitch of the rack of teeth is effectively reduced by one-half without making the teeth smaller or reducing the actual pitch of the teeth. There is enough play between pawls 24*a*, pin 28 and jaw 20 to allow the pawls to seat in the offset teeth of both racks 34*a* and 34*b*.

In an alternate embodiment, the pawl teeth and racks may be eliminated and the pawl structure 24 may be locked in position in slot 30 using a friction engagement between the edge of the slot 30 and the pawls 24*a* and 24*b*. Specifically, as the jaws contact a work piece the moveable jaw 20 is moved to the left as viewed in FIG. 1 until the pawl structure contacts the front edges of slot 30. When the pawls contact the front edges of slot 30 the pawls are rotated such that the opposite end of the pawls contact the back edges of the slot 30. By properly dimensioning the pawls, the pawls wedge themselves in slot 30 thereby fixing the position of pivot 28.

Operating lever 40 is supported at its front end 42 on moveable jaw via pivot 44. The rear end of operating lever 40 provides a moveable handle 52 such that a user can grip the stationary handle 14 and the moveable handle 52 in one hand and by squeezing the handles, close the jaws on a work piece and lock the jaws in the closed or clamping position.

The locking toggle linkage middle link 70 is pivotably connected at a central portion to the lever 40 at pivot 50. Rear end 74 of middle link 70 is pivotably connected to rear link 80 at pivot 82. In the illustrated embodiment rear link 80 is comprised of two members arrange parallel to one another as shown in FIG. 2 although a single member may be used. The rear end 84 of rear link 80 is pivotably connected to stationary handle 14 via pivot 86.

Figure 7:
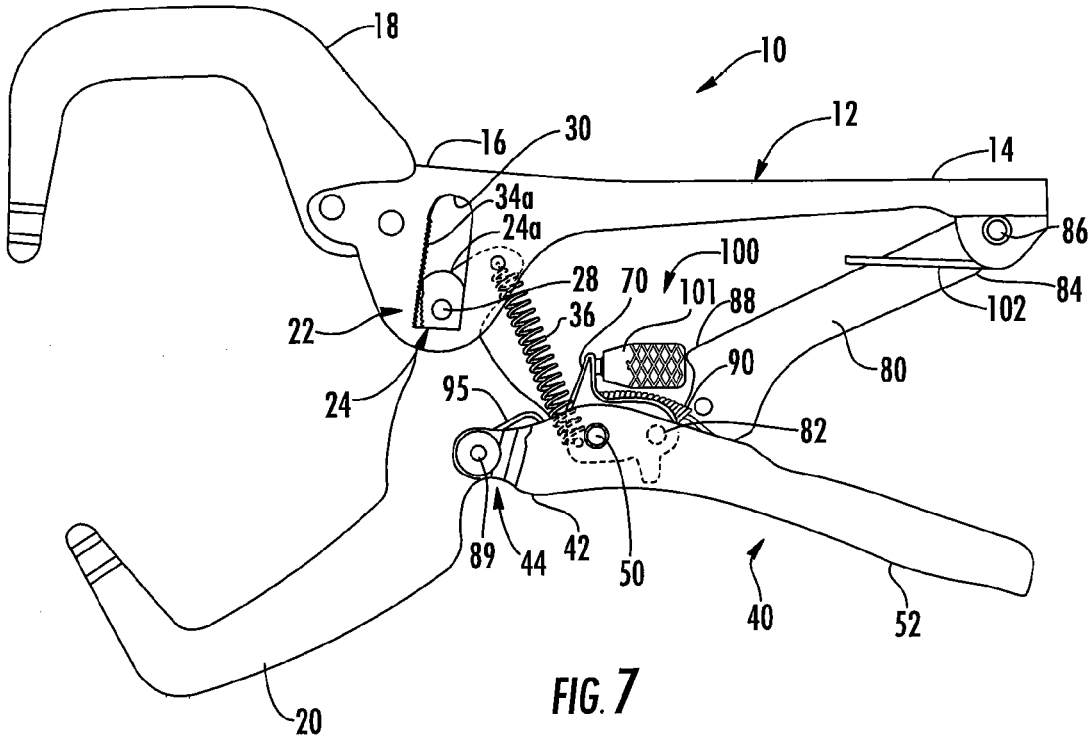
FIG. 7 is a view in side elevation of the self-adjusting locking pliers of the present invention with the jaws shown in the fully open position set for larger size work pieces.

Pivot 44 comprises a pin 89 mounted on lever 40 that engages slot 95 formed in moveable jaw 20. Slot 95 includes a first enlarged slot portion 92 connected to a second enlarged slot portion 94 by a relatively narrow connecting portion 97. Pin 89 is engageable with either enlarged slot portion 92 or enlarged slot portion 94 of slot 95. When pin 89 is engaged with slot portion 92 (FIG. 7), the jaws are spaced relatively farther apart than when pin 89 is engaged with slot portion 94 (FIG. 1). By moving the pin to one or the other of the slot portions 92 or 94, the spacing between the jaws may be varied such that the pliers can clamp relatively larger or smaller work pieces, respectively. To select the slot, pin 89 is moved along its axis against spring 90 to disengage the large diameter section of pin 89 from one of slot portions 92 or 94. The jaw is then rotated to position pin 89 in the other of the slot portions and the pin is released such that the large diameter section of pin 89 engages the other slot portion and maintains this engagement during operation of the pliers. The seats of the slot portions 92 and 94 are located on an arc of a circle centered on pivot 28 such that pin 89, when positioned in either slot portion 92 or slot portion 94, is located the same distance from pivot 28. As a result, the position of lever and the geometry of the toggle linkage is the same regardless of whether slot portion 92 or slot portion 94 is engaged by pin 89. Thus, the geometry of the linkage does not change even as the jaw spacing is changed.

A toggle preset mechanism is provided for setting the angles of the toggle locking mechanism to control the force generated by the jaws on the work piece. The preset mechanism comprises a protrusion 88 provided on the front side of rear link 80. A control actuator 100 is adjustably mounted on middle link 70 such that it can move relative to the middle link towards and away from the rear link 80. The control actuator 100 may comprise a thumb screw 101 threadably mounted on a threaded member 103 on the middle link 70 such that rotation of the thumb screw causes it to move toward and away from the rear link 80. A spring 105 may be provided between the threaded member 103 and thumb screw 101 to maintain the thumb screw in the desired position. The actuator 100 engages the protrusion 88 when the pliers are in the open position shown in FIG. 1.

A torsion spring 102 is mounted between the body 12 and the rear link 80 such that it biases the rear link about pivot 86 counterclockwise (in the direction of arrow A in FIG. 1) as viewed in the Figures. The rotation of rear link 80 about pivot 86 causes the middle link 70 to tend to rotate clockwise around pivot 82 such that the actuator 100 is forced into engagement with the protrusion 88 when the pliers are in the open position (FIG. 1). A tension spring 90 extends between middle link 70 and rear link 80. Tension spring 90 pulls the middle link 70 and the rear link 90 towards one another to maintain contact between control actuator 100 and protrusion 88 during actuation of the pliers as will hereinafter be described.

By extending actuator 100 towards or retracting actuator 100 away from the rear link 80, the "throw" of the linkage may be changed to thereby vary the amount of clamping force generated by the pliers. The "throw" of the linkage is the distance the linkage moves from the unlocked position to the locked over-center clamping position. Operation of the pliers to vary the gripping force will be explained with reference to Figs. FIG. 1 shows the pliers in the unlocked position with the jaws fully open to receive a work piece. The links are at a predetermined angular relationship relative to one another based on the position of actuator 100. To clamp a work piece, handles 14 and 52 are squeezed to move operating lever 40 towards body 12. As lever 40 moves toward body 12, moveable jaw 20 is moved towards the fixed jaw 18 with pawl structure 24 traversing slot 30. Because spring 36 biases the movable jaw 20 and pawl structure 24 toward the rear of the pliers, the teeth of pawls 24*a* and 24*b* are disengaged from racks 34*a* and 34*b* and pawl structure 24 can move freely in the slot 30. The forces generated by springs 90 and 102 maintain control actuator 100 in contact with protrusion 88 during the jaw adjustment operation. When the jaws 18 and 20 contact the work piece, moveable jaw 20 is pivoted slightly counterclockwise around pivot 44 overcoming the counterforce of spring 36 until the teeth of pawls 32*a* and 32*b* engage racks 34*a* and 34*b*. In a preferred operation, jaw 18 should contact the work piece before jaw 20. As previously explained, the pawl structure 24 may first engage either rack 34*a* or rack 34*b*. Once the pawl structure 24 engages engage either rack 34*a* or 34*b*, movement of pawl structure 24 in slot 30 is stopped and further movement of lever 40 is translated into clockwise (as viewed in FIG. 1) rotational movement of moveable jaw 20 around pivot 28 to thereby apply increasing clamping force to the work piece positioned between the jaws.

As lever 40 moves towards body 12, the locking toggle linkage is also moved towards body 12. When the work piece is clamped between the jaws 18 and 20 and increasing force is applied to the handles 14 and 52, the forces generated on the linkage overcome the forces generated by springs 90 and 102 and cause middle link 70 to pivot away from rear link 80 such that actuator 100 begins to separate from protrusion 88. As the middle link 70 separates from the rear link 80 the linkage begins to straighten and the effective length of the linkage between pivots 64 and 86 increases. As the effective length of the linkage increases, increasing force must be applied to the lever 40 to move the linkage to the over-center locked position. This force is transmitted through the pliers to the work piece to increase the clamping force generated by the jaws on the work piece. The force applied to the lever 40 also deforms the pliers such that the resiliency of the pliers stores some of the energy applied to lever 40 to maintain the clamping pressure on the work piece. The force applied to the work piece may also deform the work piece depending on the relative stiffness of the work piece.

Figure 3:
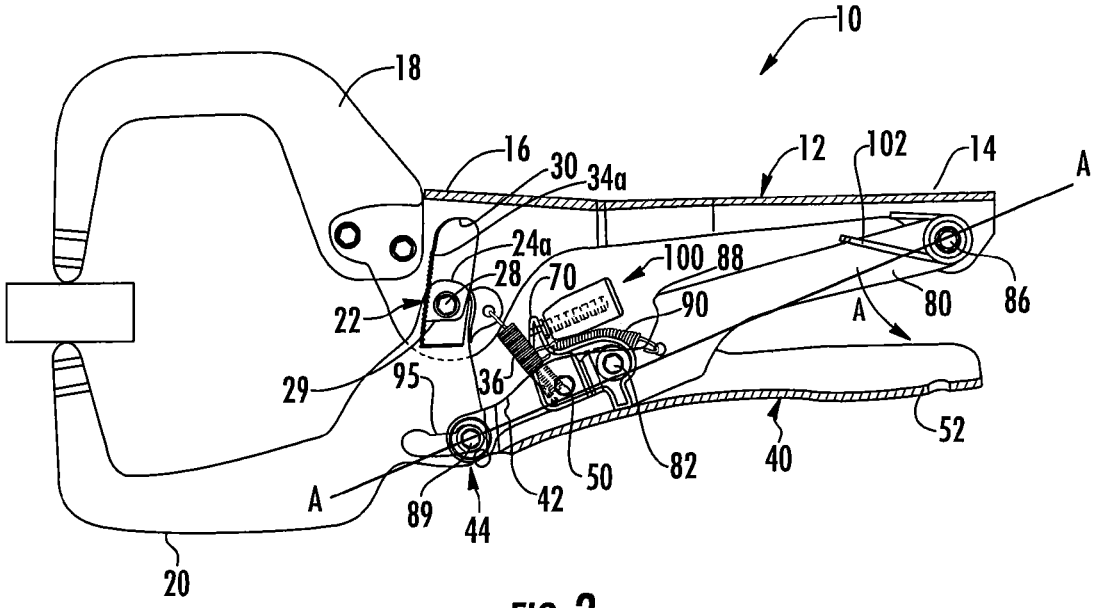
FIG. 3 is a partial section, side elevation view of the pliers shown in FIG. 1 with the jaws in the fully closed and locked position.
Figure 4:
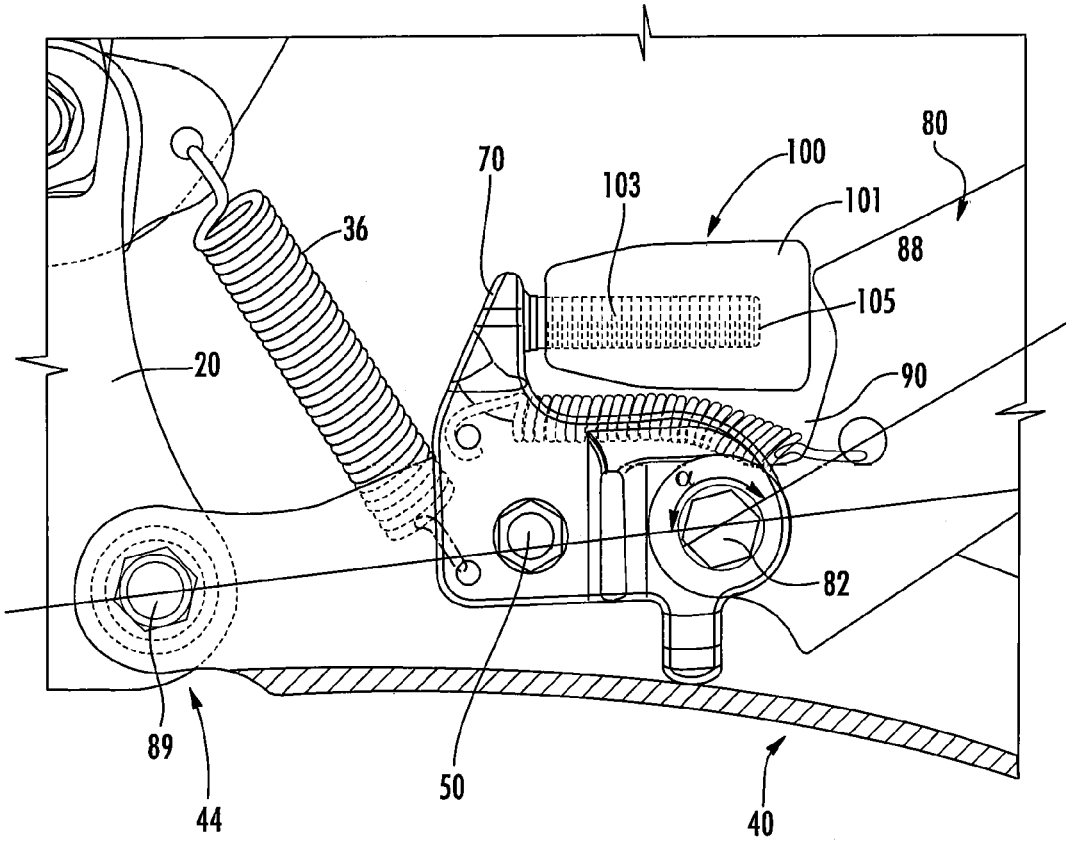
FIG. 4 is a side view of the pliers shown in FIG. 1 with the jaws open showing the linkage in greater detail.
Figure 5:
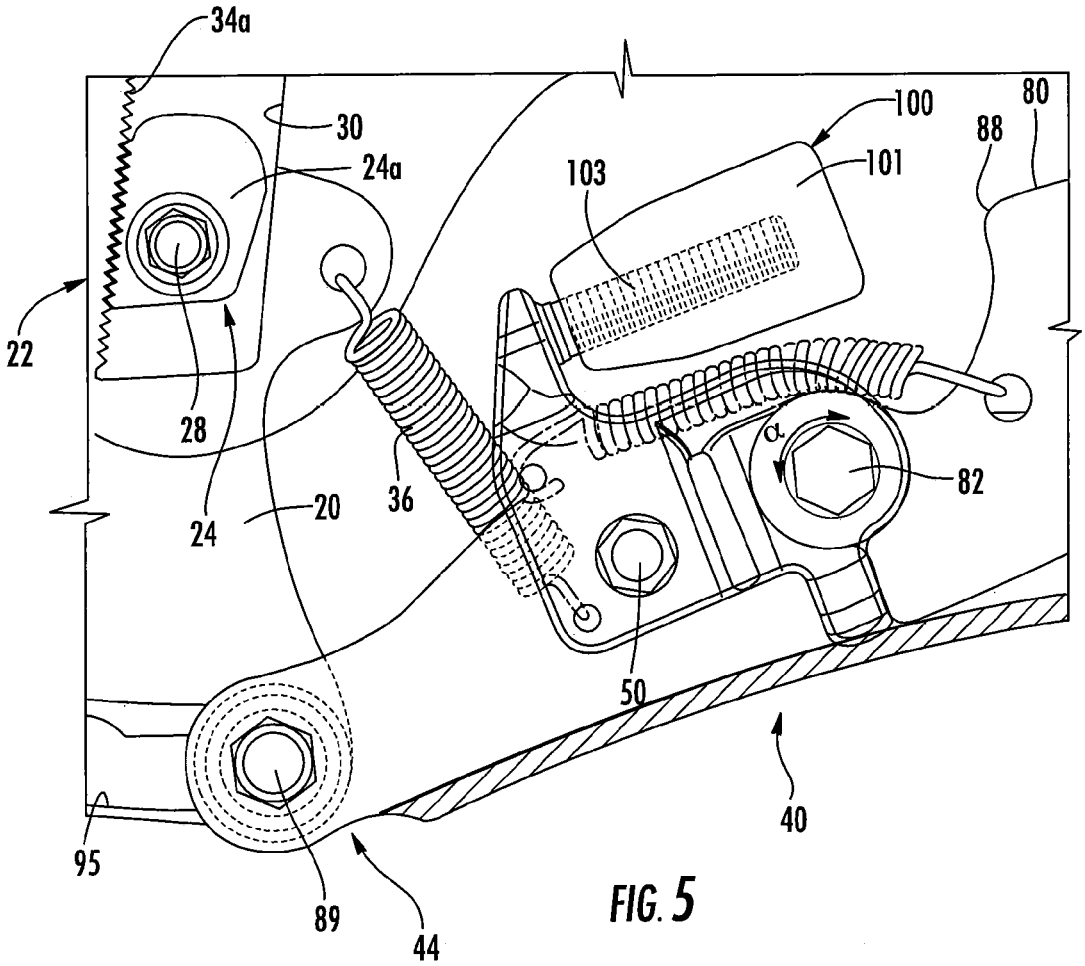
FIG. 5 is a side view of the pliers shown in FIG. 1 with the jaws closed and locked showing the linkage in greater detail.

As lever 40 is closed the force applied to the work piece increases until the linkage assumes a dead center position where pivot 44, pivot 82 and pivot 86 are in a straight line (line A-A in FIG. 3). In this position the linkage is at its greatest effective length (the distance between pivot 44 and pivot 86 is greatest) and the loading on the pliers and, therefore, the clamping force, is maximized. From this dead center position, the linkage will continue to move until pivot 82 is positioned slightly above (as viewed in FIG. 3) the line A-A between pivot 44 and pivot 86. In other words the pivot 82 moves across dead center as the tool moves from the open position to the closed and locked position. In this position the pliers are locked in an over-center clamping position where the tool will maintain the clamping force until a force is applied to the linkage forcing the linkage back over dead-center. The engagement of the forward end 90 of rear link 80 with the middle link 70 limits the distance the linkage can move beyond dead center. Limiting this distance minimizes the force reduction resulting from the shortening of the toggle linkage.

The amount of clamping force generated by the pliers of the invention is related to the angle between the middle link 70 and rear link 80 as controlled by the actuator 100. The smaller the included angle $\alpha$ (see FIG. 4) between the middle link 70 and rear link 80, the greater the throw and the greater the force generated by the pliers on the work piece. For example, an angle $\alpha$of 180 degrees would provide zero clamping force, as angle $\alpha$ decreases the clamping force increases. Conversely, the larger the angle between the middle link 70 and rear link 80, the smaller the throw and the smaller the clamping force generated by the pliers on the work piece. Where this angle is relatively small the distance between pivot 64 and pivot 86 is relatively small and the distance between pivot 82 and the dead-center line A-A (the "throw") is relatively large. As a result the pivot points 44 and 86 must travel a relatively greater distance as they are pushed apart by the linkage to reach the over-center position. The greater this distance, the greater the force the tool can exert on the work piece.

Because the preset angle $\alpha$may be preset and controlled by the position of the actuator 100 the force exerted by the device may be preset and controlled before a clamping force is applied. Moreover, the force applied by the tool, once the preset angle is set, does not vary significantly for work pieces of different sizes where the work pieces are of similar hardness. This functionality makes the pliers of the invention particularly well suited for repeated clamping operations as the pliers can be clamped to and removed from various work pieces while applying a substantially consistent clamping force to all of the work pieces without the need to manually readjust the device for each clamping action.

To use the pliers of the invention, the preset link angle is set by rotating actuator 100 until links 70 and 80 are at the desired angle relative to one another. The pliers are then applied to a work piece and a force is exerted on the lever 40 closing the jaws on the work piece. As the jaws close, pawl structure 24 moves in slot 30. When the jaws contact the work piece, the pawls 24*a* and 24*b* engage racks 34*a* and 34*b* locking pawl relative to the body 12 to properly and automatically size the jaws. During this sizing operation the preset link angle is maintained by the forces applied by springs 90 and 102 on the linkage. Continued application of force to lever 40 tightens the jaws on the work piece by rotating moveable jaw 20 about pivot 64 while simultaneously rotating the linkage toward the over-center locked position as the forces applied by springs 90 and 102 are overcome by the force applied to lever 40. As the linkage moves to the over-center position, the force on the work piece increases as the ends of the linkage extend away from one another forcing pivots 44 and 86 apart. As previously explained, the amount of force generated is a function of the amount of travel of the links that is controlled by the preset angle set by actuator 100.

The lever is moved until it reaches the over-center position where it locks the pliers in the clamped position. The jaws clamp the workpiece with the clamping force preset by actuator 100. In this position the user does not have to continue to apply force to the pliers. Once the operation on the work pieces is finished the pliers are opened to release the work piece.

The pliers can then be applied to work pieces having a different size. Because the force that will be generated by the pliers has been preset by actuator 100, the pliers clamp the work pieces without any further adjustment even if the span of the work piece is different. The pliers will function as described above to apply substantially the same amount of force to the work pieces without any readjustment of the pliers for work pieces having generally the same stiffness or hardness. This eliminates the need in the prior art self-adjusting locking pliers of having to tighten the locking pliers after the pliers are clamped on a device to control the clamping force. Because the pliers are self-adjusting the different spans of the work pieces are accommodated automatically by the movement of pawl structure 24 in slot 30 even while the jaws apply a substantially consistant clamping force. To apply a different clamping force the actuator 100 is moved to change the preset angle $\alpha$ between middle link 70 and rear link 80 as desired by the user. The pliers of the invention have utility in a wide variety of clamping and torque applying operations.

To release the pliers from the over-center locked position, the linkage must be forced back through the dead-center position to the open position of FIG. 1. This may be accomplished by pulling lever 40 away from body 12.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A locking pliers comprising:

a fixed assembly including a first jaw;

a movable jaw supported on the fixed assembly for rotational motion relative thereto;

a lever pivotably connected to the movable jaw by a pin, said lever movable between an open position and a locked clamping position; and a linkage for locking the lever relative to the fixed assembly in the clamping position, said linkage being connected to said fixed assembly at a fixed pivot and comprising a plurality of links where two of said plurality of links are disposed at a preset angle, and a means for varying the preset angle of said two of said plurality of links when said lever is in the open position to vary the clamping force generated by the pliers, wherein a first one of said plurality of links is pivotably connected to the fixed assembly and to another of said links, a second one of said plurality of links is pivotably connected to the lever and to another of said links, and no one of said plurality of links is directly connected to both the fixed assembly and the lever, and wherein the means for varying the angle between said two of said plurality of links abuts said first link when said lever is in the open position and is spaced from the first link when said lever is in the locked clamping position.

2. The locking pliers of claim 1 wherein said movable jaw translates relative to said fixed assembly.

3. The locking pliers of claim 1 wherein said means for varying the preset comprises a movable member mounted on one of said plurality of links and engaging another of said plurality of links.

4. The locking pliers of claim 3 wherein said movable member rotates to change the position of the movable member relative to the second link.

5. The locking pliers of claim 3 further including a spring biasing said linkage such that said movable member engages said at least one of said first or second link.

6. The locking pliers of claim 5 wherein said spring biases the lever away from said fixed assembly.

7. The locking pliers of claim 1 wherein said linkage comprises a first link pivotably connected to said lever and a second link pivotably connected to said fixed assembly.

8. The locking pliers of claim 7 further including a spring biasing the first link and the second link toward one another.

9. The locking pliers of claim 1 further including a spring biasing said linkage.

10. A locking pliers comprising:

a fixed assembly supporting a first jaw;

a movable jaw supported on the fixed assembly for rotational and translational motion relative thereto;

a lever pivotably connected to the movable jaw, said lever movable a distance between an open position and a locked clamping position; and a linkage for locking the lever relative to the fixed assembly in the clamping position, said linkage comprising a first link connected to said fixed assembly and a second link connected to said lever such that said lever and said fixed assembly are disposed the distance from one another in the open position, and a control actuator engaged between two of said plurality of links for presetting and changing the relative angle of said two of said plurality of links when said lever is in the open position to vary the distance in the open position and the clamping force generated by the pliers, wherein a first one of said plurality of links is pivotably connected to the fixed assembly and to another of said links, a second one of said plurality of links is pivotably connected to the lever and to another of said links, and no one of said plurality of links is directly connected to both the fixed assembly and the lever, and wherein the control actuator abuts said first link when said lever is in the open position and is spaced from the first link when said lever is in the closed position.

11. The locking pliers of claim 10 wherein said movable jaw translates relative to said fixed assembly.

12. The locking pliers of claim 10 wherein said control actuator comprises a movable member mounted on one of said plurality of links and engaging another of said plurality of links.

13. The locking pliers of claim 12 wherein said movable member rotates to change the position of the movable member relative to the second link.

14. The locking pliers of claim 10 further including a spring biasing the first link and the second link toward one another.

15. The locking pliers of claim 14 wherein said spring biases the lever away from said fixed assembly.

16. A locking pliers comprising:

a fixed assembly supporting a first jaw;

a movable jaw supported on the fixed assembly for reciprocating and rotational motion relative thereto by a pawl supported for translational movement relative to said fixed assembly, said pawl including teeth for engaging a rack of teeth on said fixed assembly wherein said rack of teeth includes a first set of teeth and a second set of teeth;

a lever pivotably connected to the moveable jaw by a pin; and a linkage for locking the lever relative to the fixed assembly in a clamping position, said linkage being connected to the fixed assembly at a fixed pivot and comprising a plurality of links, and a movable member for presetting and changing the relative angle of two of said plurality of links when said jaws are not engaged with a workpiece, wherein a first one of said plurality of links is pivotably connected to the fixed assembly and to another of said links, a second one of said plurality of links is pivotably connected to the lever and to another of said links, and no one of said plurality of links is directly connected to both the fixed assembly and the lever, and wherein the movable member abuts said first link when said jaws are not engaged with the workpiece and is spaced from the first link when said jaws are engaged with the workpiece.

17. The locking pliers of claim 16 wherein said first set of teeth are offset from said second set of teeth.

18. The locking pliers of claim 17 wherein said offset is one half the pitch of the first set of teeth.

19. A locking pliers comprising:

a fixed assembly including a first jaw;

a movable jaw supported on the fixed assembly for rotational motion relative thereto and wherein said movable jaw translates relative to said fixed assembly;

a lever pivotably connected to the moveable jaw, said lever movable between an open position and a locked clamping position; and a linkage for locking the lever relative to the fixed assembly in the clamping position, said linkage comprising a plurality of links, a first one of said plurality of links being connected to said fixed assembly and a second one of said plurality of links being connected to said lever, and a movable member mounted on one of said plurality of links and abutting the first one of said plurality of links for presetting and changing the relative angle of said one of said plurality of links and said another one of said plurality of links when said lever is in the open position to vary the clamping force generated by the pliers, and is spaced from such link when in the locked clamping position, wherein a first one of said plurality of links is pivotably connected to the fixed assembly and to another of said links, a second one of said plurality of links is pivotably connected to the lever and to another of said links, and no one of said plurality of links is directly connected to both the fixed assembly and the lever.

* * * * *